US008978604B2

(12) United States Patent
Deng et al.

(10) Patent No.: US 8,978,604 B2
(45) Date of Patent: Mar. 17, 2015

(54) VARIABLE VALVE ACTUATOR

(71) Applicant: Jiangsu Gongda Power Technologies Co., Ltd., Changshu (CN)

(72) Inventors: Qiangquan Deng, Changshu (CN); Zheng Lou, Plymouth, MI (US); Shao Wen, Changshu (CN)

( * ) Notice: Subject to any disclaimer, the term of this patent is extended or adjusted under 35 U.S.C. 154(b) by 73 days.

(21) Appl. No.: 13/850,372

(22) Filed: Mar. 26, 2013

(65) Prior Publication Data

US 2013/0255480 A1 Oct. 3, 2013

(51) Int. Cl.
*F01L 9/02* (2006.01)
*F15B 15/00* (2006.01)

(52) U.S. Cl.
CPC .. *F15B 15/00* (2013.01); *F01L 9/02* (2013.01)
USPC ..... 123/90.12; 123/90.16

(58) Field of Classification Search
CPC ..... F01L 9/02; F15B 15/00
USPC ..... 123/90.12, 90.16
See application file for complete search history.

(56) References Cited

U.S. PATENT DOCUMENTS

| | | | | |
|---|---|---|---|---|
| 4,930,464 | A | 6/1990 | Letsche | |
| 5,248,123 | A | 9/1993 | Richeson et al. | |
| 5,595,148 | A | 1/1997 | Letsche et al. | |
| 5,765,515 | A | 6/1998 | Letsche | |
| 5,809,950 | A | 9/1998 | Letsche et al. | |
| 6,167,853 | B1 | 1/2001 | Letsche | |
| 6,491,007 | B1 | 12/2002 | Kuebel et al. | |
| 6,601,552 | B2 | 8/2003 | Kuebel et al. | |
| 7,156,058 | B1 | 1/2007 | Lou | |
| 7,194,991 | B2 | 3/2007 | Lou | |
| 7,213,549 | B2 | 5/2007 | Lou | |
| 7,290,509 | B2 | 11/2007 | Lou | |
| 7,302,920 | B2 | 12/2007 | Lou | |
| 7,370,615 | B2 | 5/2008 | Lou | |
| 2007/0022986 | A1 * | 2/2007 | Lou | 123/90.12 |

FOREIGN PATENT DOCUMENTS

| | | |
|---|---|---|
| CN | 200680021728.6 | 6/2008 |
| CN | 200680028252.9 | 7/2008 |

* cited by examiner

*Primary Examiner* — Zelalem Eshete

(57) ABSTRACT

The present invention discloses an actuator, which is a combination of a hydraulic control unit and a spring-mass mechanical unit, comprising: a housing, with upper and lower ports; an actuation cylinder in the housing; an actuation piston in the actuation cylinder moveable along the longitudinal axis; a first fluid space; a second fluid space; a first piston rod connected to a first surface of the actuation piston; the second piston rod connected to a second surface of the actuation piston; a fluid bypass; a first spring system connected to the first piston rod, biasing the actuation piston in the second direction; a second spring system biasing the actuation piston in the first direction; a first flow mechanism; a second flow mechanism. The present invention also discloses two other preferred embodiments. The actuator features variable valve lift, low energy consumption, fast dynamic response, soft seating and easy controllability.

11 Claims, 5 Drawing Sheets

VARIABLE VALVE ACTUATOR

REFERENCE TO RELATED APPLICATION

This application claims the priority of the Chinese patent applications of serial no. 201210095184.5 and serial no. 201220136289.6, both of which were filed on Mar. 31, 2012, and the entire content of both of which are incorporated herein by reference.

FIELD OF THE INVENTION

This invention relates generally to actuators and corresponding methods and systems for controlling such actuators, and in particular, to actuators providing independent lift and timing control with minimum energy consumption

BACKGROUND OF THE INVENTION

Various systems can be used to actively control the timing and lift of engine valves to achieve improvements in engine performance, fuel economy, emissions and other characteristics. Depending on the means of the control or the actuator, these systems can be classified as mechanical, electrohydraulic, and electromechanical (sometimes called electromagnetic). Depending on the extent of the control, they can be classified as variable valve-lift and timing, variable valve-timing, variable valve-lift. They can also be classified as cam-based or indirect acting and camless or direct acting.

In the case of a cam-based system, the traditional engine cam system is kept and modified somewhat to indirectly adjust valve timing and/or lift. In a camless system, the traditional engine cam system is completely replaced with electrohydraulic or electromechanical actuators that directly drive individual engine valves. All current production variable valve systems are cam-based, although camless systems will offer broader controllability, such as cylinder and valve deactivation, and thus better fuel economy.

Problems with an electromechanical camless system include difficulty associated with soft-landing, high electrical power demand, inability or difficulty to control lift, and limited ability to deal with high and/or varying cylinder air pressure. An electrohydraulic camless system can generally overcome such problems, but it does have its own problems such as performance at high engine speeds and design or control complexity, resulting from the conflict between the response time and flow capability. To operate at up to 6,000 to 7,000 rpm, an actuator has to firstly accelerate and then decelerate an engine valve over a range of 8 mm within a period of 2.5 to 3 milliseconds. The engine valve has to travel at a peak speed of about 5 m/s. These requirements have stretched the limit of conventional electrohydraulic technologies.

One way to overcome this performance limit is to incorporate, in an electrohydraulic system like in an electromechanical system, a pair of opposing springs which work with the moving mass of the system to create a spring-mass resonance or pendulum system. In the quiescent state, the opposing springs center an engine valve between its end positions, i.e., the open and closed positions. To keep the engine valve at one end position, the system has to have some latch mechanism to fight the net returning force from the spring pair, which accumulates potential energy at either of the two ends. When traveling from one end position to the other, the engine valve is first driven and accelerated by the spring returning force, powered by the spring-stored potential energy, until the mid of the stroke where it reaches its maximum speed and possesses the associated kinetic energy; and it then keeps moving forward fighting against the spring returning force, powered by the kinetic energy, until the other end, where its speed drops to zero, and the associated kinetic energy is converted to the spring-stored potential energy.

With its well known working principle, this spring-mass system by itself is very efficient in energy conversion and reliable. Much of the technical development has been to design an effective and reliable latch-release mechanism which can hold the engine valve to its open or closed position, release it as desired, add additional energy to compensate for frictions and highly variable engine cylinder air pressure, and damp out extra energy before its landing on the other end. As discussed above, there have been difficulties associated with electromechanical or electromagnetic latch-release devices. There has also been effort in the development of electrohydraulic latch-release devices.

Disclosed in U.S. Pat. No. 4,930,464, assigned to DaimlerChrysler, is an electrohydraulic actuator comprising a double-ended rod cylinder, a pair of opposing springs that tends to center the piston in the middle of the cylinder, and a bypass that short-circuits the two chambers of the cylinder over a large portion of the stroke where the hydraulic cylinder does not waste energy. When the engine valve is at the closed position, the bypass is not in effect, the piston divides the cylinder into a larger open-side chamber and a smaller close-side chamber, and the engine valve can be latched when the open-side and the closed-side chambers are exposed to high and low fluid sources, respectively, because of the resulting differential pressure force on the piston in opposite to the returning spring force. When the engine valve is at the open position, the piston divides the cylinder into a larger closed-side chamber and a smaller open-side chamber, and the engine valve can be latched by exposing a large closed-side chamber and smaller open-side chamber with high and low fluid sources, respectively.

At either open or closed position, the engine valve is unlatched by briefly opening a 2-way trigger valve to release the pressure in the larger chamber and thus eliminate the differential pressure force on the piston, triggering the pendulum dynamics of the spring-mass system. The 2-way valve has to be closed very quickly again, before the stroke is over, so that the larger chamber pressure can be raised soon enough to latch the piston and thus the engine valve at its new end position. This configuration also has a 2-way boost valve to introduce extra driving force on the top end surface of the valve stem during the opening stroke.

The system just described has several potential problems. The 2-way trigger valve has to be opened and closed in a timely manner within a very short time period, no more than 3 milliseconds. The 2-way boost valve is driven by differential pressure inside the two cylinder chambers, or stroke spaces as the inventor refer as, and there is potentially too much time delay and hydraulic transient waves between the boost valve and cylinder chambers. Near the end of each stroke, the larger cylinder chamber has to be back-filled by the fluid fed through a restrictor, which demands a fairly decent opening size on the part of the restrictor. On the other hand, at the onset of each stroke, the 2-way trigger valve has to relieve the larger chamber which is in fluid communication with the high pressure fluid source through the same restrictor. During a closing stroke, there is no effective means to add additional hydraulic energy until near the very end of the stroke, which may be a problem if there are too much frictional losses. Also, this invention does not have means to adjust its lift.

DaimlerChrysler has also been assigned U.S. Pat. Nos. 5,595,148, 5,765,515, 5,809,950, 6,167,853, 6,491,007 and 6,601,552, which disclose improvements to the teachings of U.S. No. 4,930,464. The subject matter up to U.S. Pat. Nos. 5,595,148, 5,765,515, 5,809,950 and 6,167,853 resulted in various hydraulic spring means to add additional hydraulic energy at the beginning of the opening stroke to overcome engine cylinder air pressure force. One drawback of the hydraulic spring is its rapid pressure drop once the engine valve movement starts.

In U.S. Pat. No. 6,601,552, a pressure control mean is provided to maintain a constant pressure in the hydraulic spring means over a variable portion of the valve lift, which however demands that the switch valve be turned between two positions within a very short period time, say 1 millisecond. The system again contains two compression springs: a first and second springs tend to drive the engine valve assembly to the closed and open positions, respectively. The hydraulic spring means is physically in serial with the second compression spring. During the substantial portion of an opening stroke, it is attempted to maintain the pressure in the hydraulic spring despite of the valve movement and thus provide additional driving force to overcome the engine cylinder air pressure and other friction, resulting in a net fluid volume increase in the second compression spring because of a force balance between the hydraulic and compression springs. In the following valve closing stroke, the engine valve may not be pushed all the way to a full closing because of higher resistance from the second compression spring.

A concern common to this entire family of invention is that there have to be two switchover actions of the control valve for each opening or closing stroke. Another common issue is the length of the actuator with the two compression springs separated by a hydraulic spring. When the springs are aligned on the same axis, as disclosed in U.S. Pat. No. 5, 809,950, the total height may be excessive. In the remaining patents of this family, the springs are not aligned on a straight axis, but are instead bent at the hydraulic spring, and the fluid inertia, frictional losses, and the transient hydraulic waves and delays may become serious problems. Another common problem is that the closing stroke is driven by the spring pendulum energy only, and an existence of substantial frictional losses may pose a serious threat to the normal operation. As to the unlatching or release mechanism, some embodiments use a 3-way trigger valve to briefly pressurize the smaller chamber of the cylinder to equalize the pressure on both surfaces of the piston and reduce the differential pressure force on the piston from a favorable latching force to zero. Still the trigger valve has to perform two events within a very short period of time.

U.S. Pat. No. 5, 248,123 discloses another electrohydraulic actuator comprising a double-ended rod cylinder, a pair of opposing springs that tends to center the piston in the middle of the cylinder, and a bypass that short-circuits the two chambers of the cylinder over a large portion of the stroke where the hydraulic cylinder does not waste energy. Much like the referenced DaimlerChrysler patents, it has the larger chamber of the hydraulic cylinder connected to the high fluid source all the time. Different from DaimlerChrysler, however, it uses a 5-way 2-position valve to initiate the valve switch and requires only one valve action per stroke. The valve has five external hydraulic lines: a low-fluid source line, a high-fluid source line, a constant high-pressure output line, and two other output lines that have opposite and switchable pressure values. The constant high pressure output line is connected with the larger chamber of the cylinder. The two other output lines are connected to the two ends of the cylinder and are selectively in communication with the smaller chamber of the cylinder. Much like the DaimlerChrysler disclosures, it has no effective means to add hydraulic energy at the beginning of a stroke to compensate for the engine cylinder air force and frictional losses. It is not capable of adjusting valve lift either.

The Chinese patent No. 200680021728.6 (and the corresponding U.S. Pat. Nos. 7,302,920, 7,194,991 and 7,156,058 and an India patent application, No. SV/AK/218/DELNP/2008) discloses another electrohydraulic actuator, which provides 2-step lift control and continuous timing control. This technology also uses a two-spring pendulum and an electrohydraulic latch-release device, which has a more effective latch-release mechanism compared to prior technologies.

The Chinese patent application No. 200680028252.9 (and the corresponding U.S. Pat. Nos. 7,290,509, 7,213,549 and 7,370,615) discloses another electrohydraulic actuator, which also uses a two-spring pendulum and an electrohydraulic latch-release device. This technology is able to control the lift continuously, in addition to the inherent capability of continuous timing control.

SUMMARY OF THE INVENTION

The present invention is primarily intended to provide an actuator featuring variable lift control, low energy consumption, fast dynamic response, soft seating capability and easy controllability.

Briefly stated, in one aspect of the invention, one preferred embodiment of an actuator comprises a housing with upper and lower ports; an actuation cylinder in the housing, having actuation-cylinder first and second ends in first and second longitudinal directions, respectively; an actuation piston moveable longitudinally in the cylinder, with actuation-piston first and second surfaces; a first fluid space defined by the actuation-cylinder first end and the actuation-piston first surface; a second fluid space defined by the actuation-cylinder second end and the actuation-piston second surface; a first piston rod connected to the actuation-piston first surface; a second piston rod connected to the actuation-piston second surface; a fluid bypass short-circuiting the first and second fluid spaces when the actuation piston is not substantially proximate to either the actuation-cylinder first or second end; a first spring system connected to the first piston rod, biasing the actuation piston in the second direction, with at least two initial states to provide at least two different preloads on the actuation piston; a second spring system biasing the actuation piston in the first direction; a first flow mechanism, in conjunction with the first piston rod, controlling fluid communication between the first fluid space and the upper port; and a second flow mechanism, in conjunction with the second piston rod, controlling fluid communication between the second fluid space and the lower port. At least one of the first and second flow mechanisms is closed when the fluid bypass is substantially open. Each of the first and second flow mechanisms is at least partially open when the fluid bypass is substantially closed.

In one preferred embodiment, the first spring system comprises a first actuation spring, a spring retainer, a spring-control cylinder body, a fluid chamber, a flow passage and a plunger. The first actuation spring is situated between the spring retainer and the spring-control cylinder body. The spring retainer is connected to the first piston rod. The fluid chamber is situated inside the spring-control cylinder body. The flow passage passes through the plunger. The housing contains a cavity and a start port. The first spring system is situated in the cavity. The flow passage in the plunger provides connection between the fluid chamber and the start port. The spring-control cylinder body is longitudinally moveable relative to the housing to control the extent of compression of the first actuation spring along the longitudinal axis.

In one preferred embodiment, the upper port further comprises a first upper port and a second upper port. The actuator also comprises a first hydraulic fluid source connected with the upper port and a first snubber situated between the second upper port and the first hydraulic fluid source, whereby slowing down the actuation piston as the actuation piston travels close to the actuation-cylinder first end.

In one preferred embodiment, the first snubber comprises, in parallel, a first check valve, a first throttle orifice and a first relief valve.

In one preferred embodiment, the first relief valve is adjustable.

In one preferred embodiment, the lower port further comprises a first lower port and a second lower port. The actuator also comprises a second hydraulic fluid source connected with the lower port. A second snubber is situated between the second lower port and the second hydraulic fluid source, whereby slowing down the actuation piston as the actuation piston travels close to the actuation-cylinder second end.

In one preferred embodiment, the second snubber comprises, in parallel, a second check valve, a second throttle orifice and a second relief valve.

The present invention provides significant advantages over other actuators and valve control systems, and methods for controlling actuators and/or engine valves. For example, by using a unique control mechanism or structure for the first actuation spring, one is able to reduce the length of the first piston rod and the moving mass of the entire actuator, leading to compact structure, reliable slide motion, higher dynamic response and lower energy consumption. In another example, a more effective release-snubbing design is adopted to deal with the structural and functional contradictions between release and snubbing.

DETAILED DESCRIPTION OF THE INVENTION

Figure 1:
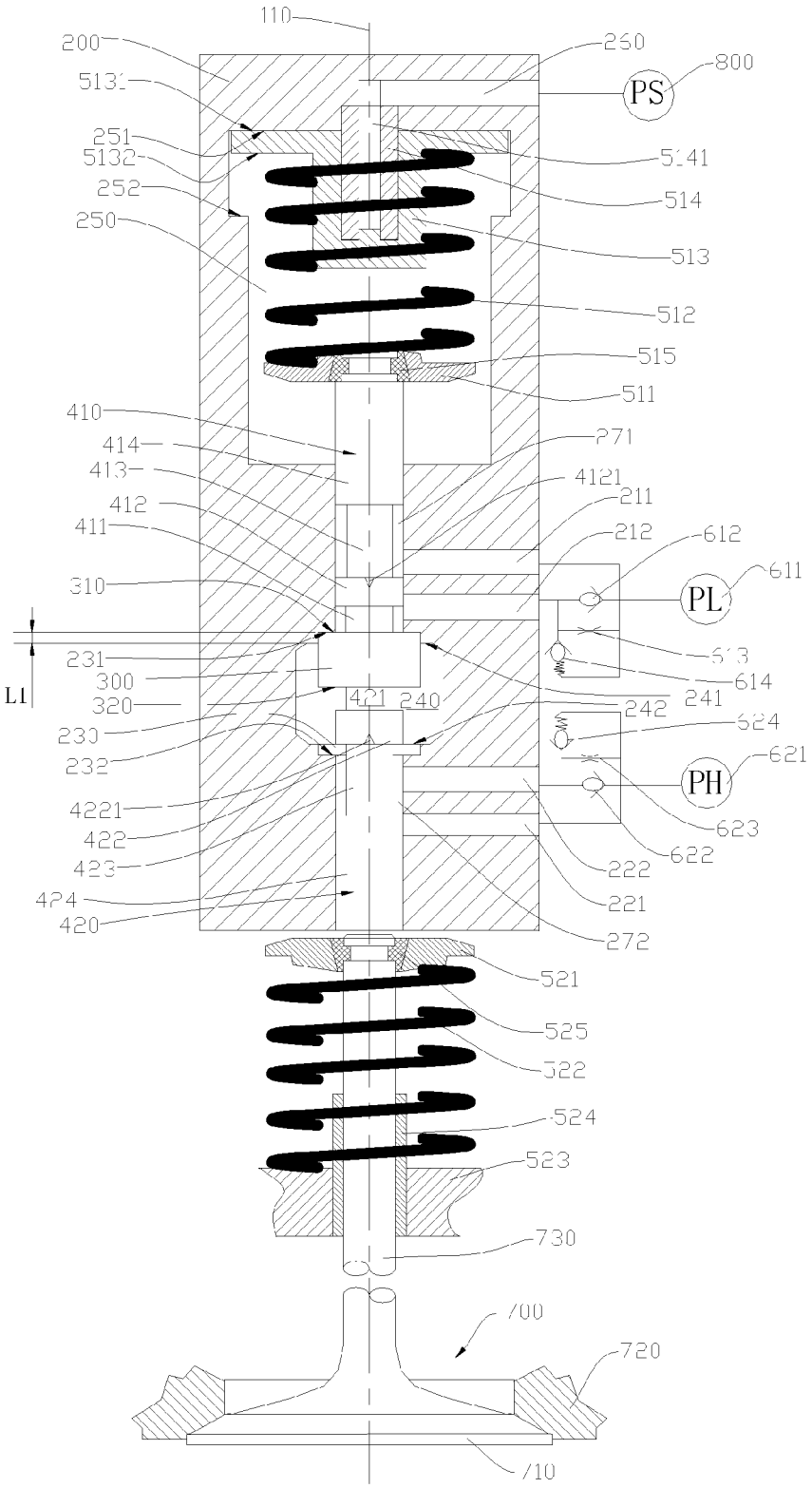
FIG. 1 is a schematic illustration of one preferred embodiment of the variable valve actuator of this invention, at the initial state of the short-lift mode.
Figure 3:
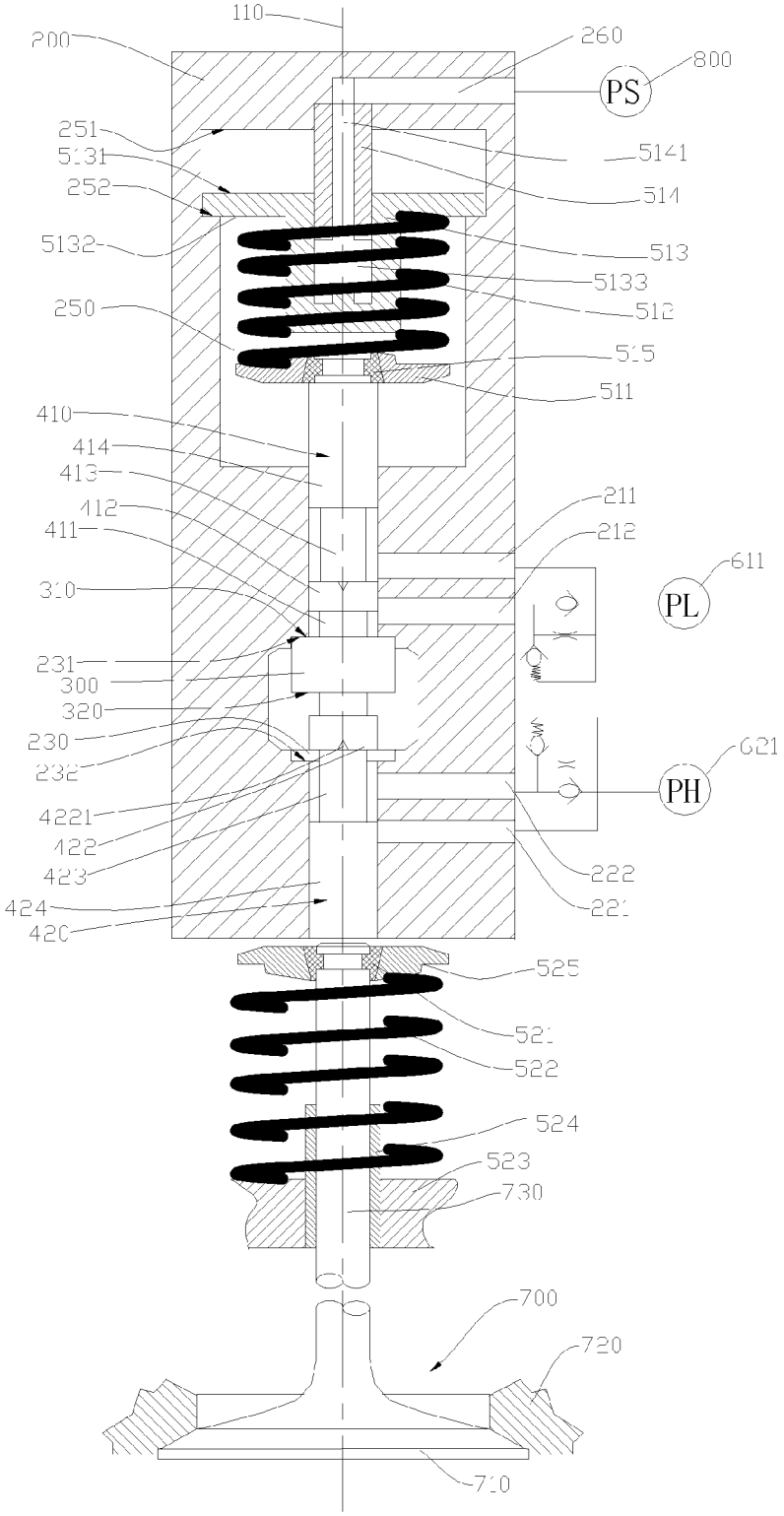
FIG. 3 is a schematic illustration of the variable valve actuator in FIG. 1, at the initial state of the full-lift mode.

Please refer to FIG. 1 and FIG. 3, a preferred embodiment of the present invention, an actuator, comprises a housing 200; in the housing 200, in the second direction (from the top to bottom in the figures) along a longitudinal axis 110, a start port 260, a cavity 250, a first control passage 271, a first upper port 211, a second upper port 212, an actuation cylinder 230, a fluid bypass 240, a second lower port 222, a first lower port 221, and a second control passage 272; in the cavity 250, a first spring system (not labeled in FIGS. 1 and 3), a first piston rod 410 in the first control passage 271, an actuation piston 300 in the actuation cylinder 230 and the fluid bypass 240, a second piston rod 420 in the second control passage 272, and a second spring system (not labeled in FIGS. 1 and 3); an engine valve 700; a start hydraulic fluid source 800 connected to the start port 260, first hydraulic fluid source 611 connected to the upper port, and a second hydraulic fluid source 621 connected to the lower port.

In FIG. 1, the first hydraulic fluid source 611 and the second hydraulic fluid source 621 are connected to a hydraulic fluid supply system controllably via a hydraulic control valve (such as a high-speed directional valve, not shown in FIG. 1), with the pressure being switched between the system high pressure (PH) and low pressure (PL). The system low pressure (PL) can be a stable low pressure controlled by a back-pressure system, and can also be a low pressure directly connected to the fuel tank. The start hydraulic fluid source 800 is at the spring control pressure (PS). The spring control pressure (PS) can be controllably connected to the hydraulic supply system via a hydraulic control valve (not shown in FIG. 1), and can also be switched between the high pressure (PH) and the low pressure (PL). The spring control pressure (PS) in FIG. 1 is set to a value that is too low to actuate the spring-control cylinder body 513 in the second direction.

The first upper port 211 and the second upper port 212 can be generally called upper port. The upper port comprises at least one of the first upper port 211 and the second upper port 212. The first lower port 221 and the second lower port 222 can be generally called lower port. The lower port comprises at least one of the first lower port 221 and the second lower port 222.

The first piston rod 410 comprises, in order of closeness to the actuation piston 300 (namely in the first direction, i.e., from the bottom towards the top in the drawings), a first-piston-rod first neck 411, a first-piston-rod first shoulder 412, a first-piston-rod second neck 413, and a first-piston-rod second shoulder 414. The first piston rod 410 and the first control passage 271 form a first flow mechanism. The internal dimension of the first control passage 271 is slightly larger than the external dimensions of the first-piston-rod first and second shoulders 412 and 414, and significantly larger than the external dimensions of the first-piston-rod first and second necks 411 and 413.

In the embodiment illustrated in FIG. 1, the first-piston-rod first and second shoulders 412 and 414 have the same external dimensions, correspondingly the first control passage 271 may only have one external dimensions. In another preferred embodiment, the external dimension of the first-piston-rod second shoulder 414 is smaller than the external dimension of the first-piston-rod first shoulder 412, and the first control passage 271 comprises two corresponding parts, namely the first and second parts, in conjunction with the first-piston-rod first and second shoulders 412 and 414, respectively. The internal dimension of the first part and the external dimension of the first-piston-rod first shoulder 412 are matched for relative slide motion, and the internal dimension of the second part and the external dimension of the first-piston-rod second shoulder 414 are matched for relative slide motion.

The second piston rod 420 comprises, in order of closeness to the actuation piston 300 (namely in second direction, i.e. from the top towards the bottom in the drawings), a second-piston-rod first neck 421, a second-piston-rod first shoulder 422, a second-piston-rod second neck 423, and a first-piston-rod second shoulder 424. The second piston rod 420 and the second control passage 271 form a second flow mechanism. The internal dimension of the second control passage 271 is slightly larger than the external dimensions of the second-piston-rod first and second shoulders 422 and 424, and significantly larger than the external dimensions of the second-piston-rod first and second necks 421 and 423.

Similar to the first flow mechanism, the second-piston-rod first and second shoulders 422 and 424 can have the same external dimensions. The external dimension of the first-piston-rod second shoulder 424 can also be smaller than that of the first-piston-rod first shoulder 422.

The actuation cylinder 230 includes a first fluid space defined by an actuation-cylinder first end 231 and an actuation-piston first surface 310, and a second fluid space defined by an actuation-cylinder second end 232 and an actuation-piston second surface 320.

The actuation cylinder 230 is in-between the actuation-cylinder first and second ends 231 and 232, the fluid bypass 240 is in-between a first edge 241 and a second edge 242, and the fluid bypass 240 provides a hydraulic short circuit in the majority of the length of the actuation cylinder 230. Fluid is able to flow between the first and second fluid spaces with a substantially low resistance because of the hydraulic short circuit, with the entire actuation cylinder 230 under a generally equal hydraulic pressure. The hydraulic short circuit ceases to function when the actuation-piston first surface 310 moves over the first edge 241 of the fluid bypass in the first direction, or when the actuation-piston second surface 320 moves over the second edge 242 of the fluid bypass in the second direction. The longitudinal space between the first edge 241 of the fluid bypass and the actuation-cylinder first end 231 is a first effective hydraulic chamber, with its length L1 illustrated in FIG. 1. The longitudinal space between the second edge 242 of the fluid bypass and the actuation-cylinder second end 232 is a second effective hydraulic chamber. The fluid bypass is in effect when the actuation piston 300 does not engage with any of the first and second effective hydraulic chambers.

The first spring system comprises a first actuation spring 512, a spring retainer 511, a spring-control cylinder body 513 and a plunger 514. The first actuation spring 512 is installed between the spring retainer 511 and the spring-control cylinder body 513. The spring retainer 511 is connected to the first piston rod 410 and fixed by valve keys 515. There is a fluid chamber 5133 in the spring-control cylinder body 513. The plunger 514 is solidly connected to the housing 200 and extends into the fluid chamber 5133. The plunger 514 and the housing 200 may also be structured together as the same part. In the plunger 514, there is a flow passage 5141 providing fluid communication between the fluid chamber 5133 and the start port 260.

In this embodiment the first actuation spring 512 is designed overhead and concentric with the first piston rod 410; and the plunger 514, fitted inside the flow passage 5141, is designed to guide the reciprocating motion of the spring-control cylinder body 513 and to distribute hydraulic fluid as the first actuation spring 512 is compressed. The advantages are as follows: it can avoid lengthwise over-extension of the first piston rod 410 caused by the spring-control mechanism (the spring retainer 511) and the effective spring work stroke when the first actuation spring 512 and the first piston rod 410 are not only concentric but also longitudinally overlapped, so that one can reduce the length of the first piston rod 410 and also its diameter and mass, which leads to a reduction in the mass of the moving parts of the whole actuator, an increase in actuator velocity and a decrease in energy consumption. The control mechanism of the first actuation spring is compact, and the guidance is stable and reliable, thus to avoid lateral force in its process of compressing the first actuation spring 512. Both end segments of the piston rods are supported the housing so as to maximize the support length of the piston rods and minimize the lateral torque on the piston rods during their travel, thus improving the stability of the actuator.

The cavity 250 does not have to be a closed cavity as illustrated in FIG. 1. In fact, a passage (not shown in FIG. 1) should be designed to ensure the communication between the cavity 250 and the atmosphere, so as to make sure that the air can be exchanged during the moving process of the spring-control cylinder body 513. The top of the housing 200 does not even have to be continuous or directly continuous with the other part of the housing 200 (not shown in the FIG. 1), as long as the top of the housing 200 has no movement relative to the rest of the housing 200.

The second spring system comprises a valve spring retainer 521, a second actuation spring 522, a valve guide 524 and a cylinder head block 523. The valve spring retainer 521 is connected to one end of a valve stem 730, and the other end of the valve stem 730 is connected to the engine valve head 710. The cylinder head block 523 is located in-between the valve spring retainer 521 and the engine valve head 710, the valve guide 524 is installed in the cylinder head block, and the valve stem 730 goes through the valve guide. The second actuation spring 522 is installed around the valve stem 730 and supported by the cylinder head block 523 and the valve spring retainer 521.

The first upper port 211 directly communicates with the first hydraulic fluid source 611 via a flow conduit and the second upper port 212 communicates with the first hydraulic fluid source 611 via a first snubber. The first snubber comprises, in parallel, a first check valve 612, a first throttle orifice 613 and a first relief valve 614. The first lower port 221 directly communicates with the second hydraulic fluid source 621 via a flow conduit, and the second lower port 222 communicates with the second hydraulic fluid source 621 via a second snubber. The second snubber comprises, in parallel, a second check valve 622, a second throttle orifice 623 and a second relief valve 624. Wherein, the check valves are intended to supply pressurized fluid in open direction and to cut off the backflow in the opposite direction thus to form a snubbing chamber. The throttle orifices are intended to throttle for snubbing. One is to set-up a reasonable cross-section area for the throttle orifices in order to obtain soft and stable seating at the final stage of snubbing for the piston rod, and also to reduce the sensitivity of snubbing to temperature. The relief valves are intended to limit the peak pressure in the snubber by relieving, thus preventing the valve velocity from being reduced prematurely during the snubbing process. Premature velocity reduction will lead to a prolonged snubbing process and improper gas exchange, especially under a high engine speed. A relief valve with an adjustable relief pressure may be preferred so that the peak pressure of the snubber can be controlled according to load conditions. The snubbing time may be less than 0.7 ms at high engine speed, and thus the dynamic response of the relief valves has to be fast.

At least one first throttle slot 4121 is cut on the first-piston-rod first shoulder 412 next to the end surface of the first-piston-rod second neck 413. The throttle area of the first throttle slot 4121 is variable, being gradually smaller in the second direction. At the end of the second-piston-rod first shoulder 422, close to the second-piston-rod second neck 423, there is at least one second throttle slot 4221. The throttle area of the second throttle slot 4221 is variable, being gradually smaller in the first direction. The throttle area of the throttle slots is designed to be variable so as to achieve stable snubbing process for the piston rod.

FIG. 1 is a schematic illustration of the initial state of the actuator at its short lift mode. The first actuation spring is pre-compressed at the initial state. The upper surface 5131 of the spring-control cylinder body is in contact with a cavity first limit surface 251. The second hydraulic fluid source supply fluid to the space below the actuation piston 300, the hydraulic force applied to the actuation-piston second surface 320, in the first direction, is far more than the reaction force of the first actuation spring in the second direction, The actuation-piston first surface 310 is in contact with the actuation-cylinder first end 231, and at this point the first piston rod 410 and the second piston rod are in the initial state, and the engine valve is closed.

Figure 2:
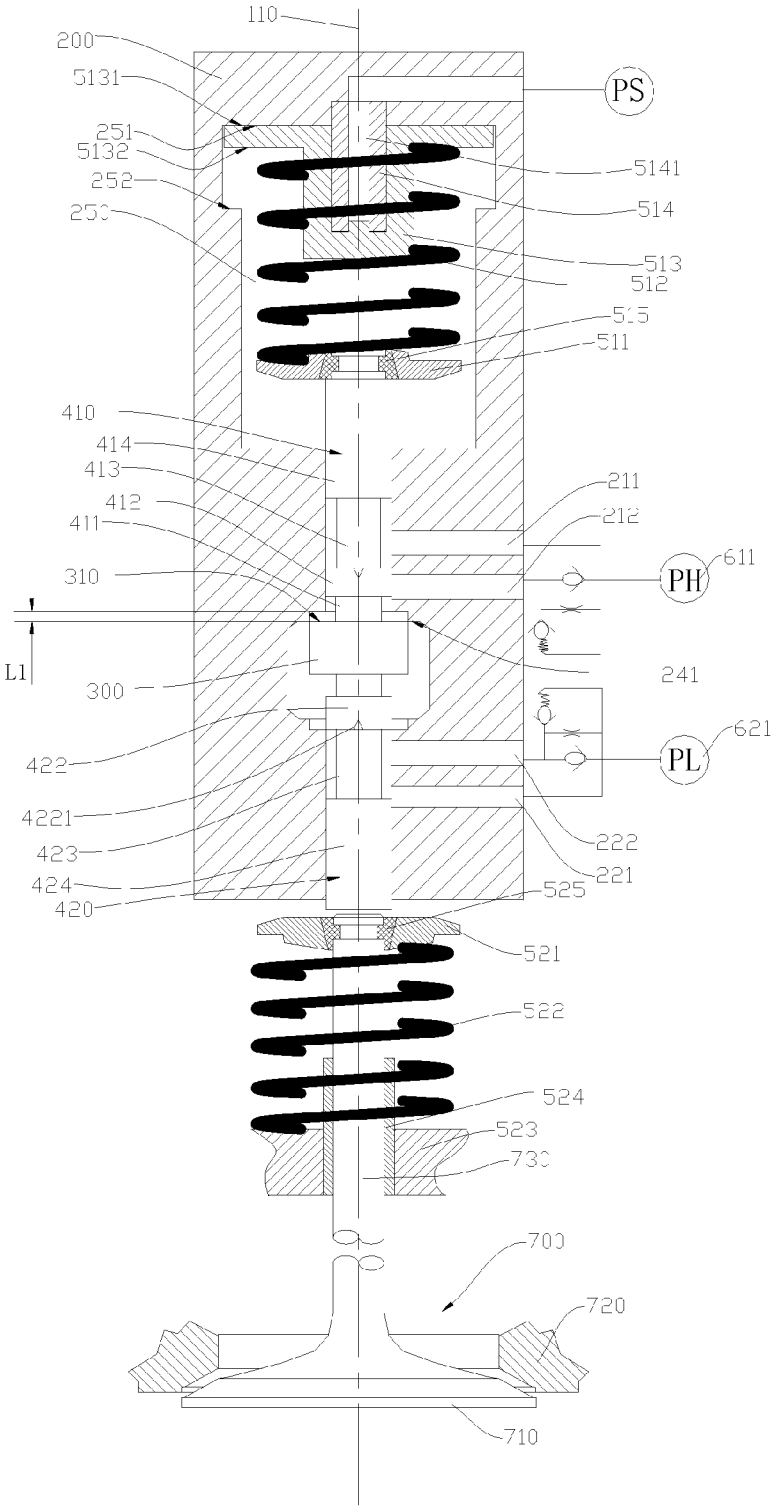
FIG. 2 is a schematic illustration of the variable valve actuator in FIG. 1, with the engine valve at the fully-open state of the short-lift mode.

Referring to FIG. 1 and FIG. 2, the operation process of the valve short lift mode of the actuator is as follows: when the first and second hydraulic fluid sources 611 and 621 are switched to the system high pressure (PH) and low pressure (PL) respectively by the hydraulic control circuit, the system high pressure (PH) and low pressure (PL) apply to the first and second fluid spaces respectively, the actuation piston 300 and its piston rods 410 and 420 move out quickly for a certain stroke (approximately equal to the length L1 of the first effective hydraulic chamber of the actuation cylinder 230, with the exact stroke being somehow affected by the extent of the compression of the springs and the system pressures) to drive open the engine valve 700 under the joint action of the total spring force and hydraulic force, with the first and second actuation springs 512 and 522 experiencing reduced and increased compressions, respectively. In the meantime the second-piston-rod first shoulder 422 closes flow return passage for the lower fluid space and the engine valve keeps its open position. When the first hydraulic fluid source 611 and the second hydraulic fluid source 621 are respectively switched back to system low pressure (PL) and system high pressure (PH) by the hydraulic control circuit, the system low pressure (PL) and system high pressure (PH) are applied to the first and second fluid spaces respectively, the actuation piston 300 and its piston rods 410 and 420 retract to the initial state illustrated in FIG. 1 under the joint action of the total spring force and hydraulic force. The entire actuator is driven by compression and release (conversion between kinetic energy and potential energy) of the two symmetrical springs (the first and second actuation springs 512 and 522), and the hydraulic circuit is used to compensate for the energy loss during the reciprocating process of the springs and also control the action of the valve.

The design of the piston rods in the present invention makes the fluid distribution logics at the initial and final stages of the piston reciprocating motion different from each other. At the initial stages of the piston rod movement in the first and second directions, system fluid returns directly to the tank via the first upper port 211 and the first lower port 221, respectively; and at the final stages of the piston rod movement in the first and second directions, system fluid has to initially return to a snubber via the first upper port 211 and the first lower port 221, respectively, and finally back to the tank, thus working with the snubbing mechanisms and achieving the snubbing function at both ends of the stroke.

FIG. 3 is a schematic illustration of the initial state of the actuator at it's the valve full lift mode, the spring control pressure (PS) is set to a high value in order to make the hydraulic force capable of driving the spring-control cylinder body 513 in the second direction until the lower surface 5132 of the spring-control cylinder body 513 comes in contact with a cavity second limit surface 252, when the extent of the pre-compression of the first actuation spring 512 is significantly increased (compared to the state illustrated in FIG. 1), and the equilibrium point of the total force of the upper 512 and lower 522 actuation springs is moved forward in the second direction to increase the valve lift. The first hydraulic fluid source 611 and the second hydraulic fluid source 621 (therefore also for the first and second fluid spaces) are connected to the system high pressure (PH) and low pressure (PL), and the hydraulic force applied on the actuation-piston second surface 320 is larger than the joint reaction force (now in the second direction) of the actuation springs 512 and 522, and the actuation-piston first surface 310 is in contact with the actuation-cylinder first end 231. At this point the piston 300 and the piston rods 410 and 420 are at the initial state, and the engine valve is closed.

Figure 4:
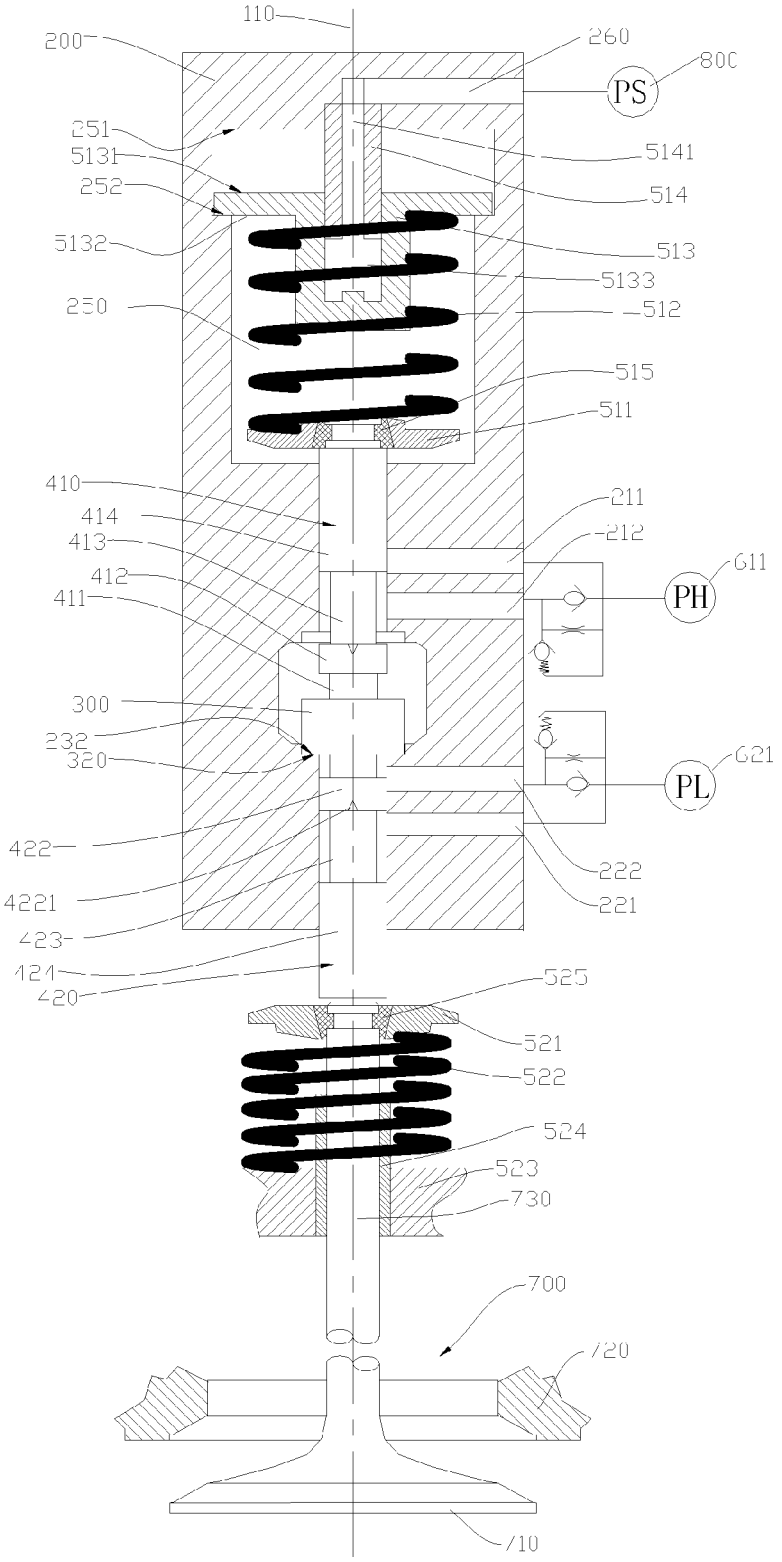
FIG. 4 is a schematic illustration of the variable valve actuator in FIG. 1, at the fully-open state of the full-lift mode.

Referring to FIG. 3 and FIG. 4, the operation process of the actuator at the valve full lift mode is as follows: when the first hydraulic fluid source 611 and the second hydraulic fluid source 621 are switched, respectively, to the system high pressure (PH) and low pressure (PL) (as illustrated in FIG. 4) by the hydraulic control circuit, the system high pressure (PH) and low pressure (PL) apply to the first and second fluid spaces respectively, and the actuation piston 300 and its piston rods 410 and 420 move out quickly in the second direction under the joint action of the total spring force and the hydraulic force. During this process, the hydraulic fluid in the first fluid space is supplied through the check valve 612. When the actuation-piston first surface 310 moves across the first edge 241, the fluid bypass 240 effectively short-circuits the first and second fluid spaces, and the hydraulic pressures in the fluid spaces above and below the actuation piston 300 are generally equal to each other, there are therefore no hydraulic force and no unnecessary hydraulic energy consumption, and the actuation piston 300 and the piston rods 410 and 420 continue to move forward in the second direction under the inertial force and the net spring force. When the actuation piston 300 and the piston rods 410 and 420 travel approximately half way through the lift, the net spring force starts changing directions and hindering the movement, and the kinetic energy is converted and stored as the potential energy; the actuation piston 300 and piston rods 410 and 420 however are still driven in its downward motion by the inertial force but are slowed down gradually. When the actuation-piston second surface 320 moves across the second edge 242, the fluid bypass 240 is closed, the first and second fluid spaces are back to be exposed to the system high pressure (PH) and low pressure (PL) respectively; the second-piston-rod first shoulder 422 separates the first and second lower ports 221 and 222, setting the second lower port 222 as a snubber (with the second throttle slot 4221 on the second-piston-rod first shoulder 422 as a part of the snubbing mechanism); after the actuation piston 300 and piston rods 410 and 420 are slowed down by the snubber, the actuation-piston second surface 320 overlaps with the actuation-cylinder second end 232, the stroke of the movement is over, the engine valve 700 is driven to be fully open, the extents of the compressions of the first and second actuation springs 512 and 522 are decreased and increases respectively, and the hydraulic force applied on actuation piston 300 is sufficient to resist the reverse net force of the actuation springs to maintain the engine valve 700 in its open position. In the above snubbing process, the check valve 622 has always been in the closed state under a reverse hydraulic force. The second throttle slot 4221 releases part of the hydraulic fluid back to the upper chamber of the actuation cylinder to prevent bounce back caused by excessive snubbing; the second throttle orifice 623 is always in a flow state in order to use the flow resistance to generate a snubbing pressure in the snubber, and the snubbing pressure is applied to the actuation-piston second surface to slow down the actuation piston and associated moving parts; the snubbing elements described above have some limitation because of varying work conditions of the engine, for example, the snubbing pressure may be too high instantaneously to cause bounce back or excessive snubbing time, and then the second relief valve 624 can open quickly to reduce the peak pressure in the snubber.

When the first and second hydraulic fluid sources 611 and 621 are respectively switched back to the system low pressure (PL) and high pressure (PH) by the hydraulic control circuit, the system low pressure (PL) and high pressure (PH) are applied to the first and second fluid spaces respectively, the actuation piston 300 and its piston rods 410 and 420 retract in the first direction to the initial state illustrated in FIG. 3 under the joint action of the net spring force and hydraulic force, and the logic of the travel process is similar but opposite to the engine valve opening process.

The short lift is used mainly at engine startup and low-speed low-load work conditions, and the full lift is used at engine middle- and high-speeds high-load work condition.

In FIG. 4, when the second piston rod 420 moves to the final stage of the stroke in the second direction, the second-piston-rod first shoulder 422 separates the first and second lower ports 221 and 222 respectively, setting up the first lower port 221 as a snubbing chamber; and second throttle slot 4221 on the second-piston-rod first shoulder 422 is a part of the snubbing mechanism.

Figure 5:
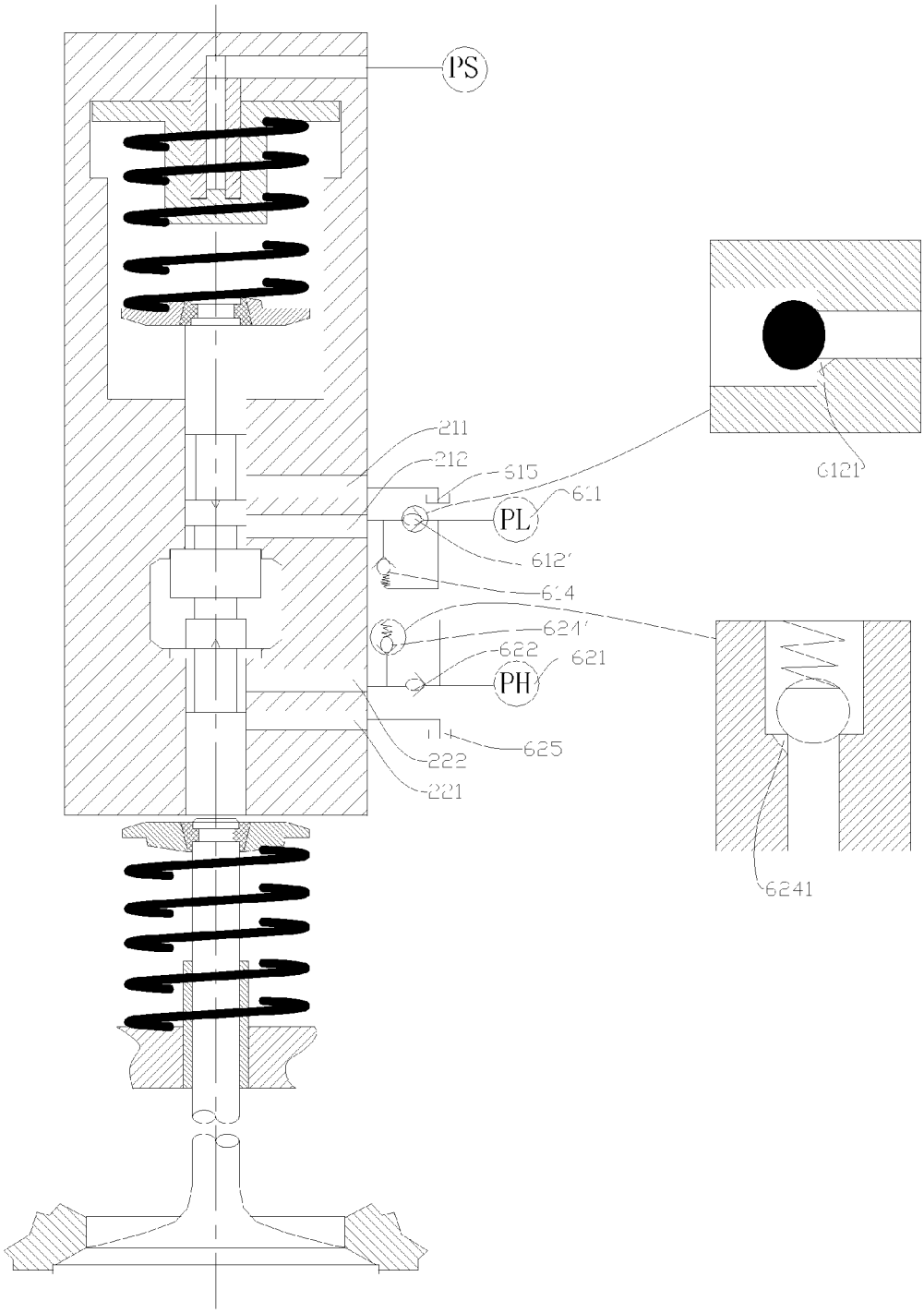
FIG. 5 is a schematic illustration of another embodiment of the variable valve actuator of this invention.

FIG. 5 is schematic illustration of a variation of the preferred embodiment illustrated in FIG. 1, and one big difference from the actuator illustrated in FIG. 1 is: both the first upper port 211 and the first lower port 221 are directly connected to the tank 615, and it makes the system simpler in some cases, without changing the original design intention for the two ports (i.e., the fluid return function of the first upper port 211 and the first lower port 221); the snubbing mechanism comprises, in parallel, the check valve and the relief valve.

Another big difference between the actuators illustrated in FIG. 5 and FIG. 1 is: the throttle orifice in FIG. 5 may also be designed to be one or more slots or grooves on the port of the relief valve or the check valve, with the slots allowing a limited flow even when the relief valve or the check valve is closed. In FIG. 5, for example, the first throttle orifice 6121 is integrated at the port of the first check valve 612', and the second throttle orifice 6241 is integrated at the port of the second relief valve 624'.

Compared to the embodiment in FIG. 1, in another embodiment of the present invention the diameter of the first piston rod second shoulder 414 is smaller than the diameter of the first-piston-rod first shoulder 412, so as to generate an extra force to overcome extra resistant force (such as that experienced by an engine exhaust valve during opening) to drive the engine valve 700 in second direction, i.e. downward; correspondingly, the first control passage 271 also can be set as two parts (not shown in FIG. 1) matching with the first-piston-rod first and second shoulders 412 and 414 respectively, and their respective bores match with the diameters of the first-piston-rod first and second shoulders 412 and 414 respectively for relative slide motion.

In many figures and descriptions the fluid medium is assumed to be oil or hydraulic or liquid form, and in most cases the same concept can be applied to pneumatic or water-based-fluid actuators and systems through designing in appropriate proportion. Similarly, the terminology "fluid" used herein includes liquids and gases.

In the above descriptions and in FIG. 1 to FIG. 5, the first and second piston rods are basically symmetric, and so are their respective or corresponding first and second flow mechanisms, but the present invention also include those actuators with one set of piston rod and corresponding flow mechanism being like those described above and illustrated in FIG. 1 to FIG. 5. and another set of piston rod and corresponding flow mechanism adopting the design of the piston rod and flow mechanism in existing technologies (refer to the Chinese patent 200680021728.6).

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

We claim:

1. An actuator, comprising:

A housing, comprising upper and lower ports;

an actuation cylinder in the housing, having actuation-cylinder first and second ends in first and second longitudinal directions, respectively;

an actuation piston moveable longitudinally in the cylinder, with actuation-piston first and second surfaces;

a first fluid space defined by the actuation-cylinder first end and the actuation-piston first surface;

a second fluid space defined by the actuation-cylinder second end and the actuation-piston second surface;

a first piston rod connected to the actuation-piston first surface;

a second piston rod connected to the actuation-piston second surface;

a fluid bypass short-circuiting the first and second fluid spaces when the actuation piston is not substantially proximate to either the actuation-cylinder first or second end;

a first spring system connected to the first piston rod, biasing the actuation piston in the second direction, with at least two initial states to provide at least two different preloads on the actuation piston;

a second spring system biasing the actuation piston in the first direction;

a first flow mechanism, in conjunction with the first piston rod, controlling fluid communication between the first fluid space and the upper port; and a second flow mechanism, in conjunction with the second piston rod, controlling fluid communication between the second fluid space and the lower port;

wherein:

at least one of the first and second flow mechanisms is closed when the fluid bypass is substantially open;

each of the first and second flow mechanisms is at least partially open when the fluid bypass is substantially closed;

the first spring system comprises a first actuation spring, a spring retainer, a spring-control cylinder body, a fluid chamber, a flow passage and a plunger;

the first actuation spring is situated between the spring retainer and the spring-control cylinder body;

the spring retainer is connected to the first piston rod;

the fluid chamber is situated inside the spring-control cylinder body;

the flow passage passes through the plunger;

the housing contains a cavity and a start port;

the first spring system is situated in the cavity;

the flow passage in the plunger provides connection between the fluid chamber and the start port; and the spring-control cylinder body is longitudinally moveable relative to the housing, whereby changing the extent of compression of the first actuation spring along the longitudinal axis.

2. An actuator, comprising:

a housing, with upper and lower ports, and the upper port further comprising a first upper port and a second upper port;

an actuation cylinder in the housing, having actuation-cylinder first and second ends in first and second longitudinal directions, respectively;

an actuation piston moveable longitudinally in the cylinder, with actuation-piston first and second surfaces;

a first fluid space defined by the actuation-cylinder first end and the actuation-piston first surface;

a second fluid space defined by the actuation-cylinder second end and the actuation-piston second surface;

a first piston rod connected to the actuation-piston first surface;

a second piston rod connected to the actuation-piston second surface;

a fluid bypass short-circuiting the first and second fluid spaces when the actuation piston is not substantially proximate to either the actuation-cylinder first end or the actuation-cylinder second end;

a first spring system biasing the actuation piston in the second direction;

a second spring system biasing the actuation piston in the first direction;

a first flow mechanism, in conjunction with the first piston rod, controlling fluid communication between the first fluid space and the upper port; and a second flow mechanism, in conjunction with the second piston rod, controlling fluid communication between the second fluid space and the lower port;

wherein:

at least one of the first and second flow mechanisms is closed when the fluid bypass is substantially open;

each of the first and second flow mechanisms is at least partially open when the fluid bypass is substantially closed;

the first piston rod comprises, in order of closeness to the actuation piston, a first-piston-rod first neck, a first-piston-rod first shoulder, a first-piston-rod second neck and a first-piston-rod second shoulder, each of which having an external dimension;

the first flow mechanism comprises a first control passage having at least one internal dimension;

the at least one internal dimension of the first control passage is slightly larger than the external dimensions of the first-piston-rod first and second shoulders, and significantly larger than the external dimensions of the first-piston-rod first and second necks;

the first-piston-rod first shoulder and the first control passage longitudinally overlap when the fluid bypass is substantially open, whereby blocking fluid communication between the first fluid space and the upper port; and the first-piston-rod first shoulder and the first control passage longitudinally overlap between the first and second upper ports when the actuation-piston first surface moves close to the actuation-cylinder first end, whereby blocking fluid communication between the first and second upper ports.

3. The actuator of the claim 2, wherein:

the external dimension of the first-piston-rod second shoulder is smaller than the external dimension of the first-piston-rod first shoulder;

the first control passage comprises two parts, namely first and second parts, correspondingly to the first-piston-rod first and second shoulders, respectively;

the internal dimension of the first part of the control passage and the external dimension of the first-piston-rod first shoulder are matched for relative slide motion; and the internal dimension of the second part of the control passage and the external dimension of the first-piston-rod second shoulder are matched for relative slide motion.

4. The actuator of the claim 2, wherein at least one first throttle slot is cut on the first-piston-rod first shoulder next to the first-piston-rod second neck.

5. The actuator of the claim 2, further comprising:

a first hydraulic fluid source connected with the upper port; and a first snubber situated between the second upper port and the first hydraulic fluid source, whereby slowing down the actuation piston as the actuation piston travels close to the actuation-cylinder first end.

6. The actuator of the claim 5, wherein the first snubber comprises, in parallel, a first check valve, a first throttle orifice and a first relief valve.

7. The actuator of the claim 6, wherein the first relief valve is adjustable.

8. An actuator, comprising:

a housing, with upper and lower ports, and with the lower port further comprising a first lower port and a second lower port;

an actuation cylinder in the housing, having actuation-cylinder first and second ends in first and second longitudinal directions, respectively;

an actuation piston, moveable longitudinally in the cylinder, with actuation-piston first and second surfaces;

a first fluid space defined by the actuation-cylinder first end and the actuation-piston first surface;

a second fluid space defined by the actuation-cylinder second end and the actuation-piston second surface;

a first piston rod connected to the actuation-piston first surface;

a second piston rod connected to the actuation-piston second surface;

a fluid bypass short-circuiting the first and second fluid spaces when the actuation piston is not substantially proximate to either the actuation-cylinder first end or the actuation-cylinder second end;

a first spring system biasing the actuation piston in the second direction;

a second spring system biasing the actuation piston in the first direction;

a first flow mechanism, in conjunction with the first piston rod, controlling fluid communication between the first fluid space and the upper port; and a second flow mechanism, in conjunction with the second piston rod, controlling fluid communication between the second fluid space and the lower port;

wherein at least one of the first and second flow mechanisms is closed when the fluid bypass is substantially open;

each of the first and second flow mechanisms is at least partially open when the fluid bypass is substantially closed;

the second piston rod comprises, in order of closeness to the actuation piston, a second-piston-rod first neck, a second-piston-rod first shoulder, a second-piston-rod second neck and a second-piston-rod second shoulder, each of which having an external dimensions;

the second flow mechanism comprises a second control passage having at least one internal dimension;

the at least one internal dimension of the second control passage is slightly larger than the external dimensions of the second-piston-rod first and second shoulders, and significantly larger than the external dimensions of the second-piston-rod first and second necks;

the second-piston-rod first shoulder and the second control passage longitudinally overlap when the fluid bypass is substantially open, whereby blocking fluid communication between the second fluid space and the lower port; and the second-piston-rod first shoulder and the second control passage longitudinally overlap between the first and second lower ports when the actuation-piston second surface moves close to the actuation-cylinder second end, whereby blocking fluid communication between the first and second lower port.

9. The actuator of the claim 8, wherein at least one second throttle slot is cut on the second-piston-rod first shoulder next to the second-piston-rod second neck.

10. The actuator of the claim 8, further comprising:

a second hydraulic fluid source connected with the lower port; and a second snubber situated between the second lower port and the second hydraulic fluid source, whereby slowing down the actuation piston as the actuation piston travels close to the actuation-cylinder second end.

11. The actuator of the claim 10, wherein the second snubber comprises, in parallel, a second check valve, a second throttle orifice and a second relief valve.

* * * * *